US009353576B2

(12) United States Patent
Skaggs

(10) Patent No.: US 9,353,576 B2
(45) Date of Patent: May 31, 2016

(54) HAMMER BIT

(75) Inventor: Roger D. Skaggs, Farmington, MO (US)

(73) Assignee: International Tool Corporation, Farmington, MO (US)

( * ) Notice: Subject to any disclaimer, the term of this patent is extended or adjusted under 35 U.S.C. 154(b) by 476 days.

(21) Appl. No.: 13/611,760

(22) Filed: Sep. 12, 2012

(65) Prior Publication Data

US 2014/0069722 A1 Mar. 13, 2014

(51) Int. Cl.
*E21B 10/36* (2006.01)
*E21B 10/38* (2006.01)

(52) U.S. Cl.
CPC ..... *E21B 10/38* (2013.01); *E21B 10/36* (2013.01)

(58) Field of Classification Search
USPC ..... 175/417, 57, 414, 416, 418, 390, 339, 175/393, 398
See application file for complete search history.

(56) References Cited

U.S. PATENT DOCUMENTS

| | | | | | |
|---|---|---|---|---|---|
| 4,819,746 | A * | 4/1989 | Brown et al. | ..... | 175/296 |
| 6,148,935 | A * | 11/2000 | Wentworth et al. | ..... | 175/398 |
| 6,260,634 | B1 * | 7/2001 | Wentworth et al. | ..... | 175/61 |
| 6,263,983 | B1 * | 7/2001 | Wentworth et al. | ..... | 175/19 |
| 6,827,159 | B2 * | 12/2004 | Sved | ..... | 175/74 |
| 7,726,419 | B2 * | 6/2010 | Cruz | ..... | 175/430 |
| 2002/0060095 | A1 * | 5/2002 | Wentworth et al. | ..... | 175/73 |
| 2003/0024741 | A1 * | 2/2003 | Wentworth et al. | ..... | 175/73 |

* cited by examiner

*Primary Examiner* — Taras P Bemko
(74) *Attorney, Agent, or Firm* — Polsinelli PC

(57) ABSTRACT

A hammer bit is herein described with tapered lateral sides and a modified face section. The tapered lateral sides taper inward towards a rear portion of the hammer bit. The modified face section includes a gauge portion and a larger angled or heel portion. The hammer bit provides improved penetration and directional control for drilling into the earth.

30 Claims, 5 Drawing Sheets

HAMMER BIT

FIELD OF THE INVENTION

The present invention relates to a new and improved hammer bit, which includes a face side and tapered lateral sides that join with the face side.

BACKGROUND OF THE INVENTION

Hammer bits are used to bore into the earth during mining and drilling operations. The hammer bit is mounted to a lower end of a drill string, which simultaneously rotates and lowers the hammer bit, in a reciprocating manner, into the earth to dig and bore into the earth. Hammer bits bore through all types of earth and rock formations.

Existing hammer bits generally include a face side having a gauge portion and a small heel section that hammers into the earth. The face side is the leading cutting surface of the existing hammer bit. Existing hammer bits generally include flat sidewalls that are parallel to the drill string. Existing hammer bits position flushing holes in the face section. These flushing holes may clog with dirt, rock, or debris. The flushing holes expel a drilling fluid to exhaust the hammer bit and to clear drill cuttings from the bore hole.

Although existing hammer bits are generally effective at boring holes into the earth, the existing hammer bits can suffer from a loss of directional control. Also, under certain conditions, existing hammer bits are not very efficient in boring into the earth, as the existing hammer bits lead with the flat face section.

SUMMARY OF THE INVENTION

A hammer bit is herein described with tapered sides. The tapered sides form lateral sides or side portions of the hammer bit. The hammer bit further includes a face side having an angled portion. The tapered sides join the face side and a back body portion of the hammer bit. The tapered sides of the hammer bit are generally steeper than the sides of existing bits. The tapered sides improve the rate of penetration of the hammer bit into rock and earth. The face side may include generally flat and/or concaved surfaces.

Further, a hammer bit is herein described with a modified face side. The modified face side has curved and concaved surfaces that bore into the earth. The curved and concaved surfaces further transition into an angled portion, which is longer than is typically found on the conventional hammer bits. The hammer bit includes a gauge portion, a conical portion, and an angled portion that form the modified face side for the hammer bit and provide improved penetration and directional control for drilling into the earth. The face side includes a reduced size and multiple angled and curving surfaces that provide the improved penetration and directional control.

The gauge portion forms a gauge cutting surface around a periphery of the hammer bit. The gauge portion is adjacent to the angled portion and the conical portion. The conical portion is generally between the gauge portion and the angled portion.

The gauge portion, conical portion, and the angled portion provide the hammer bit with the modified face side that is different in design and function from existing hammer bits. In operation, the hammer bit first cuts an outer diameter of a bore hole with the gauge cutting surface of the gauge portion. The gauge cutting surface may leave a center area of the bore hole with a roughly conical shaped core, which is easily chipped up and broken off by cutting teeth that are positioned in the conical portion of the hammer bit. The angled portion provides a wedge-shaped surface on approximately one-half or more of the face side of the hammer bit. The large surface area of the angled portion provides a larger area to deflect the earth when drilling into soft formations and assists in navigating in any drilling condition, which improves penetration and directional control. The gauge portion transitions into the angled portion, and the conical portion is between the angled portion and the gauge portion.

The hammer bit includes the face side with a reduced surface area compared to existing hammer bits. The surface area of the face side is about half the size of the surface area of the face sides of existing hammer bits. With the reduced size, the hammer bit does not have as many cutters striking the surface in the face of the bore hole, which allows for each cutter to have a deeper penetration rate every time the hammer bit strikes the bore hole.

The hammer bit further includes flushing holes or hammer exhaust holes positioned behind the gauge portion, i.e., at an outer side position on the hammer bit. By positioning the flushing holes behind the gauge portion, the flushing holes are less likely to clog or occlude. The flushing holes still project drilling air or drilling fluids to jet away soft earthy materials and to provide a pilot hole for the hammer bit to follow. These features give the hammer bit the ability to be navigated in any desired direction in any type of rock or earth formation including dirt, sand, cobble, etc.

One or more additional flushing holes or hammer exhaust holes are also placed in the face side of the hammer bit. The holes intersect with the holes behind the gauge portion to prevent or reduce the likelihood of the respective holes from becoming plugged in soft drilling formations.

The hammer bit further includes the angled portion that helps to guide the hammer bit when the hammer bit is being used in a directional boring operation. The angled portion forms an elongated heel that is larger than the heels of existing hammer bits. The conical shape also assists in guiding the direction of the hammer bit.

DETAILED DESCRIPTION OF THE INVENTION

Figure 1:
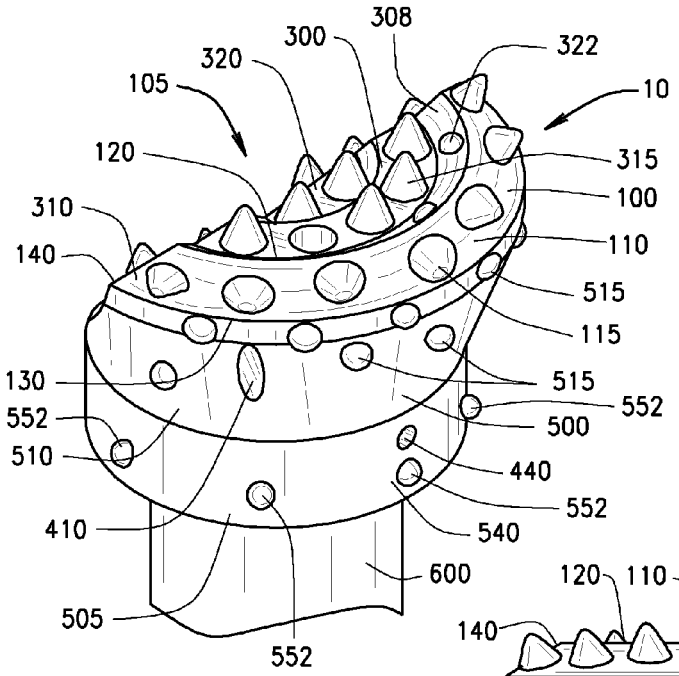
FIG. 1 shows a perspective view of the hammer bit.

A hammer bit is herein described with tapered sides. The hammer bit further includes a face side having an angled portion. The face side forms a leading cutting surface of the hammer bit. The tapered sides join the face side and a back body portion of the hammer bit. The tapered sides form lateral sides or side portions of the hammer bit. The taper sides taper inward toward the back body portion. The tapered sides of the hammer bit are generally steeper than the sides of existing bits. The tapered sides improve the rate of penetration of the hammer bit into rock and earth. The face side may include generally flat and/or concaved surfaces.

A hammer bit is herein described with a modified face side. The face side is directed into the earth during a drilling procedure. The face side includes a reduced surface area and multiple angled and curving surfaces that provide improved penetration and directional control. The hammer bit includes a gauge portion, a conical portion, and an angled portion that form the face side for the hammer bit and provide the improved penetration and directional control for drilling into the earth or into rock. The hammer bit uses the gauge portion to provide a leading cutting surface to bore a gauge of the bore hole. The hammer bit uses the conical portion to crush the earth or rock inside of the gauge portion. The angled portion efficiently wedges into the earth or rock with its long tapered surface.

A hammer bit 10 will now be described with reference to FIGS. 1-11. The hammer bit 10 generally includes a gauge portion 100 that is integral or connects with an angled portion 200. A combination of the gauge portion 100 and the angled portion 200 generally circumscribe or at least partially define a conical portion 300. The gauge portion 100, the angled portion 200, and the conical portion 300 form a face side 105 of the hammer bit 10 that provides improved directional control and penetration efficiency.

Figure 2:
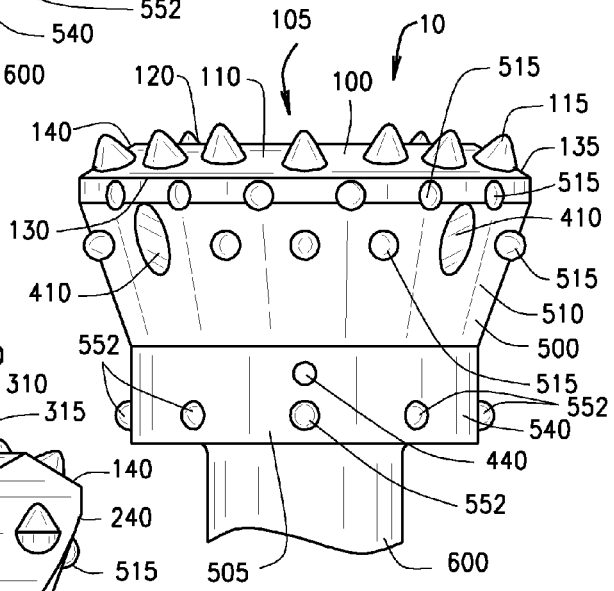
FIG. 2 shows a view of the gauge portion of the hammer bit.

The gauge portion 100 will now be described with reference to FIG. 2. As the hammer bit 10 bores into the earth, the gauge portion 100 first cuts an outside diameter of a bore hole. The gauge portion 100 is curved or rounded and forms a leading cutting surface for the hammer bit 10 as the hammer bit 10 is drilled into the earth. The gauge portion 100 forms a peripheral or outer edge of at least a portion of the hammer bit 10. The gauge portion 100 extends from the face side 105. The face side 105 is opposite of a drill string side 505, which forms a rear of the hammer bit 10.

The gauge portion 100 may cover approximately one-half of the outer circumference of the hammer bit 10. As such, the gauge portion 100 is smaller than a gauge portion on conventional hammer bits. In other aspects, the size of the gauge portion 100 relative to the remainder of the hammer bit 10 may be reduced to cover approximately one-third of the outer circumference of the hammer bit 10.

Figure 6:
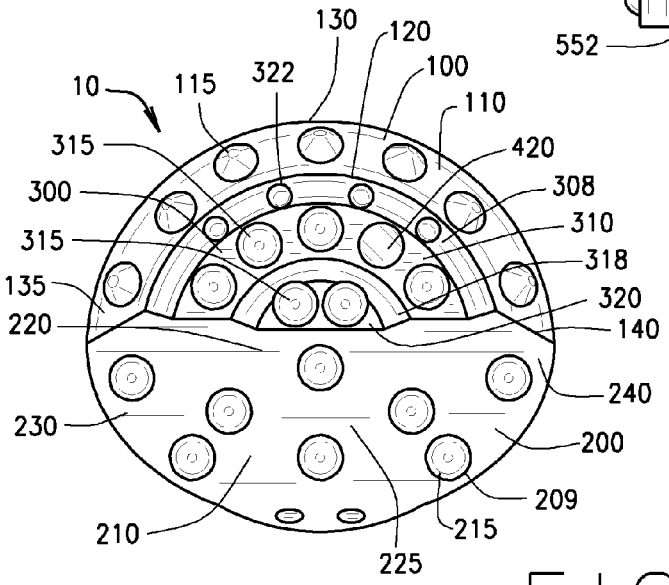
FIG. 6 shows a top down view of the hammer bit.
Figure 7:
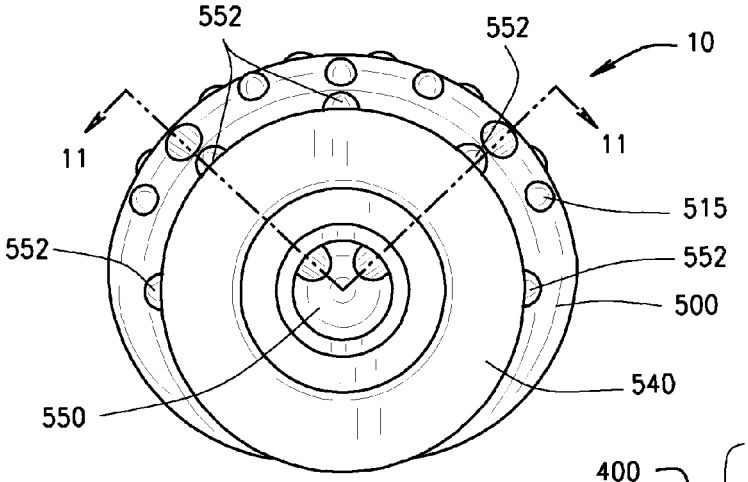
FIG. 7 shows a bottom view of the hammer bit.
Figure 8:
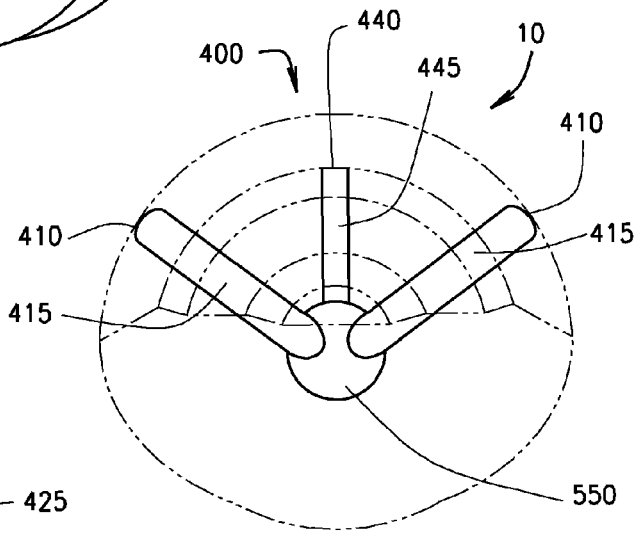
FIG. 8 shows a sectional view of the flushing system of the hammer bit.
Figure 9:
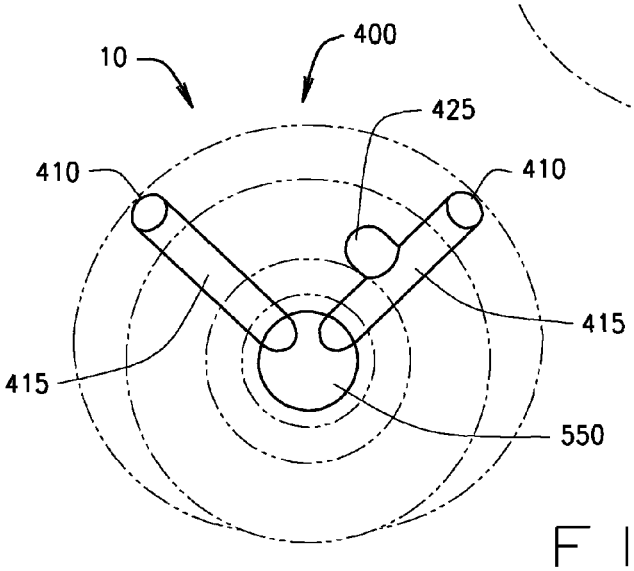
FIG. 9 shows a sectional view of the flushing system of the hammer bit.
Figure 10:
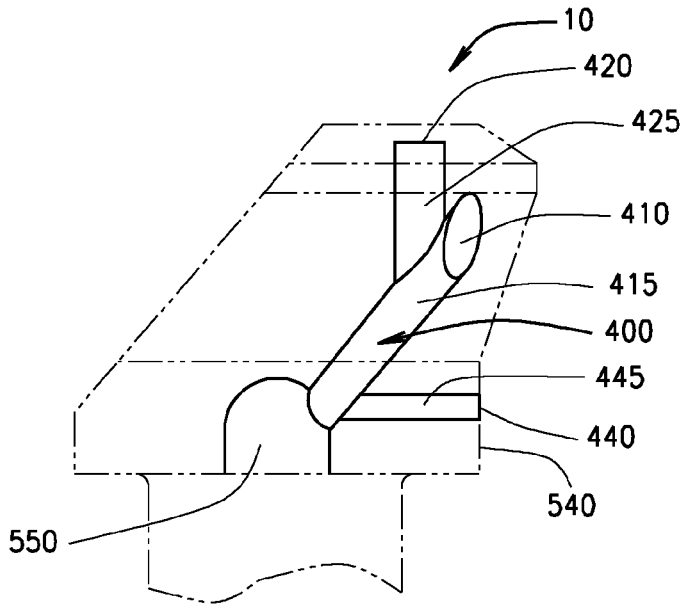
FIG. 10 shows a sectional view of the flushing system of the hammer bit.
Figure 11:
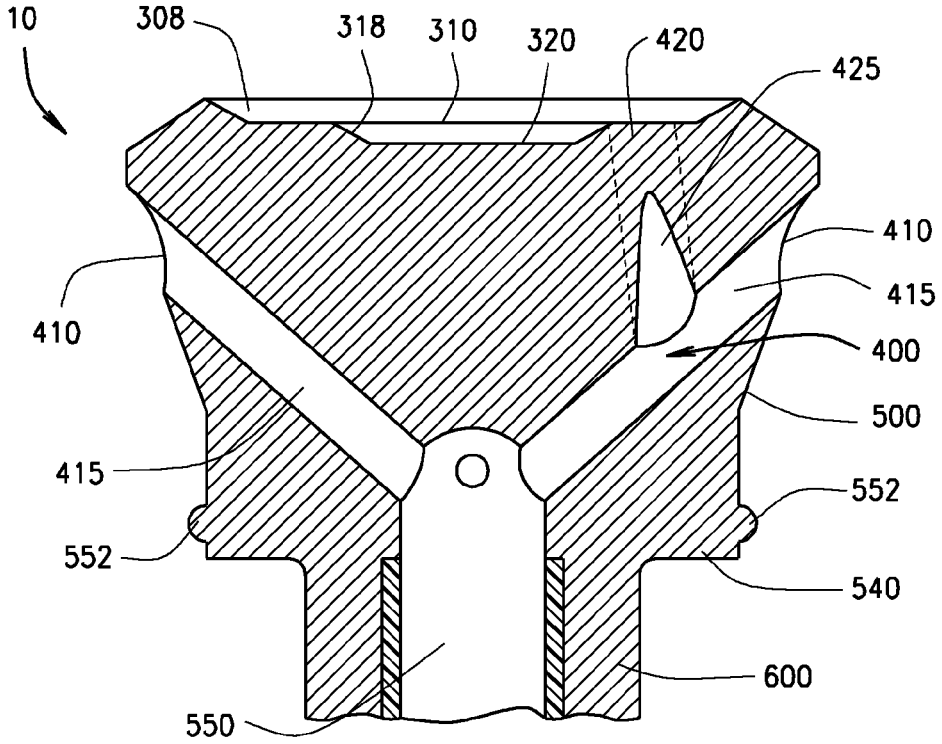
FIG. 11 shows a sectional view of the flushing system of the hammer bit.

With respect to FIG. 6, the gauge portion 100 includes a gauge cutting surface 110, which is defined by a gauge inner edge 120 and a gauge outer edge 130. The gauge cutting surface 110 is positioned between the conical portion 300 and an outer body 500 of the hammer bit 10. The gauge cutting surface 110 includes a plurality of gauge cutters 115 that are integral with or attached to the gauge cutting surface 110. The gauge cutters 115 may be pressed, screwed, or otherwise urged into the gauge cutting surface 110. The gauge cutting surface 110 may include approximately two gauge cutters 115 to approximately twenty gauge cutters 115 depending upon the size of the gauge cutters 115, the shape of the gauge cutters 115, anticipated drilling conditions, and the size of the gauge cutting surface 110. The gauge cutters 115 may include a rounded, squared, pointed, or other shape that is suitable for cutting into rock and earth. The gauge cutters 115 may extend approximately one half inch to approximately two inches from the gauge cutting surface 110. The gauge cutter 115 may include a diameter or exterior dimension of approximately one half inch to approximately two inches.

The gauge cutting surface 110 is defined by the gauge inner edge 120 and the gauge outer edge 130. The gauge inner edge 120 is generally at an apex or intersection of the gauge cutting surface 100 and the conical portion 300. The gauge inner edge 120 is typically higher than the gauge outer edge 130, i.e., the gauge inner edge 120 slopes downward to the gauge outer edge 130. This provides the gauge cutting surface 110 with a downward slope between the gauge inner edge 120 and the gauge outer edge 130. The gauge cutting surface 110 may include a generally rounded to a generally flat surface that is angled downward to the gauge outer edge 130.

Both the gauge inner edge 120 and the gauge outer edge 130 include an arcuate or semicircular shape. The gauge cutting surface 110 may form a half-moon shape. The gauge cutting surface 110 is further defined on its sides by a gauge first lateral edge 135 and a gauge second lateral edge 140. The gauge first lateral edge 135 and the gauge second lateral edge 140 join the gauge inner edge 120 and the gauge outer edge 130, respectively.

In other aspects, the gauge portion 100 may be broken into two or more separate sections that partially circumscribe the exterior diameter of the hammer bit 10. The separate sections may include a space or gap between the sections. In other aspects, the gauge portion 100 may include a cutting edge formed between the gauge inner edge 120 and the gauge outer edge 130, with the gauge cutting surface 110 having separate surfaces that join together forming the cutting edge.

Figure 3:
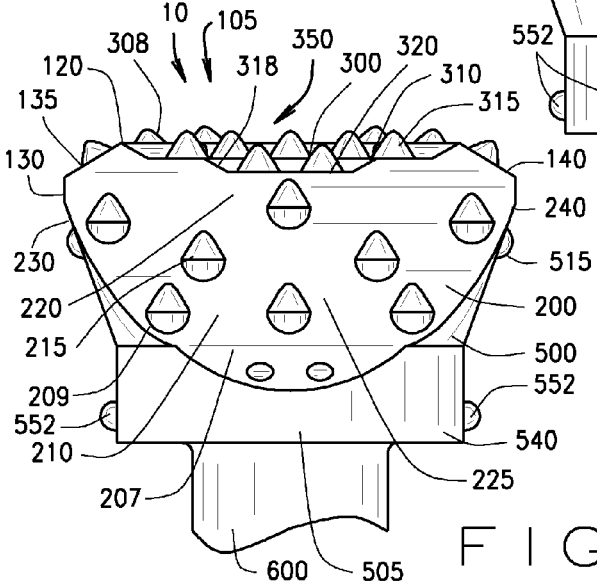
FIG. 3 shows a view of the angled portion of the hammer bit.
Figure 4:
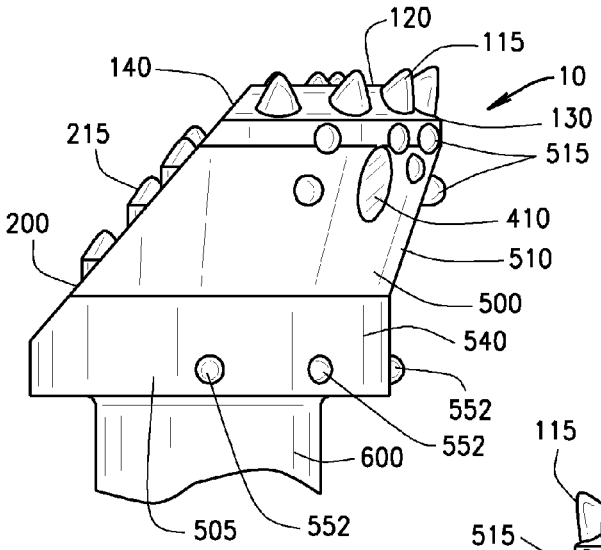
FIG. 4 shows a side view of the hammer bit.
Figure 5:
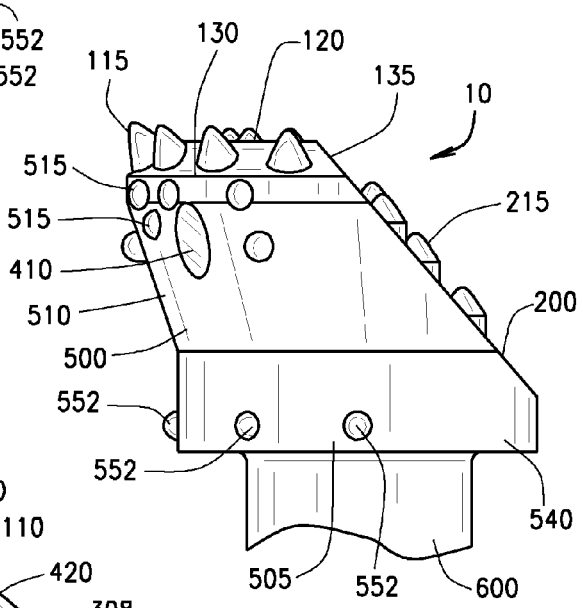
FIG. 5 shows another side view of the hammer bit.

The angled portion 200 will now be described with reference to FIG. 3. The gauge first lateral edge 135 and the gauge second lateral edge 140 transition or are integral with the angled portion 200. The angled portion 200 provides an angled surface that wedges into the earth. The angled portion 200 includes a tapered surface 210 with a plurality of cutting teeth 215. The angled surface 210 includes approximately two cutting teeth 215 to approximately twenty cutting teeth 215. The number of cutting teeth 215 will depend on the size of the cutting teeth 215, the shape of the cutting teeth 215, the size of the angled surface 210, and the anticipated drilling conditions. The cutting teeth 215 are attached or integrated into receivers 209 of the angled surface 210. The cutting teeth 215 may include a rounded, squared, pointed, or other shape that is suitable for cutting into rock and earth. The cutting teeth 215 may extend approximately one half inch to approximately two inches from the angled surface 210. The cutting teeth 215 may include a diameter or exterior dimension of approximately one half inch to approximately two inches. The cutting teeth 215 may extend in a forward direction for a more rapid rate of penetration into harder rock. As such, the cutting teeth 215 are generally parallel with the direction of the hammer bit 10. In other aspect, the cutting teeth 15 may be inserted in a slight downward direction.

The angled surface 210 is at an angle of approximately 30° to approximately 70° with respect to a longitudinal axis of the hammer bit 10. In other aspects, the angled surface 210 is at an angle of approximately 20° to approximately 80° with respect to the longitudinal axis of the hammer bit 10.

The angled portion 200 is adjacent both the gauge portion 100 and the conical portion 300. With reference to FIGS. 3-6, the angled portion 200 includes an upper tapered portion 220 that is integral with the gauge first lateral edge 135 and the gauge second lateral edge 140. The upper tapered portion 220 leads into a main area 225 of the angled portion 200. The angled portion 200 includes a first lateral side 230 and a second lateral side 240. With reference to FIG. 6, the upper tapered portion 220 and the gauge portion 100 are positioned around the conical portion 300.

The face side 105 has a generally ovular cross-section. The angled portion 200 and the gauge portion 100 form the perimeter or exterior of the ovular cross-section. The gauge portion 100 provides the leading cutting surface for the face side 105. The conical portion 300 generally follows the gauge portion 100, and the angled portion 200 generally follows the conical portion 300. With reference to FIG. 3, the angled portion 200 forms an elongated heel 207 that is larger than existing hammer bits. The angled portion 200 includes a surface area for the heel 207 that is approximately 90% to approximately 110% larger than a heel of existing hammer bits.

In other aspects, the angled portion 200 may include the angled surface 210 with a slight curve or arcing between the conical portion 300 and the heel 207. The angled surface 210 may further include a slight curve or arcing between the first lateral side 230 and the second lateral side 240.

The conical portion 300 will now be described with reference to FIG. 6. The conical portion 300 includes one or more cutting surfaces recessed from the gauge portion 100. The one or more cutting surfaces may include cutting teeth. For example, the conical portion 300 may include one or mores flat areas or steps as the cutting surfaces. These flat areas or steps provide a flat area for cutting teeth 315 to be placed where they will strike in a forward motion. These flat areas or steps may be generally perpendicular to the longitudinal axis of the hammer bit 10. The forward placement of the cutting teeth 315 allows for a more rapid penetration rate into harder rock.

With reference to FIG. 6, a first conically shaped transition surface 308 of the conical portion 300 connects the gauge inner edge 120 with a first flat surface 310, which provides a cutting surface. A second conically shaped transition surface 318 connects the first flat surface 310 with a second flat surface 320, which also provides a cutting surface. The stair-step pattern formed by the first flat surface 310 and the second flat surface 320 may continue to a center of the conical portion 300 of the hammer bit 10. Each of the first and second conically shaped transition surfaces 308 and 318 may optionally include wear buttons 322. In other aspects, additional conically shaped transition surface may connect with additional flat surfaces. As such, there may be a third, fourth, fifth, etc. flat surfaces and conically shaped transition surfaces.

The number of flat surfaces or cutting surfaces will vary with the diameter of the hammer bit 10 and the diameter of the cutting teeth 315. In the example shown in FIGS. 1-11, the first flat surface 310 has a depth of approximately 0.300 inches and a width of approximately 0.500 inches. The second flat surface 320 may have identical, similar, or different dimensions. The flat surfaces 310 and 320, comprise a plurality of the cutting teeth 315. The conical portion 300 and its flat surfaces 310 and 320 may include approximately two to approximately twenty of the cutting teeth 315 depending upon the size of the cutting teeth 315, the shape of the cutting teeth 315, the size of the flat surfaces 310 and 320, and the anticipated drilling conditions. The cutting teeth 315 may include a rounded, squared, pointed, or other shape that is suitable for cutting into rock and earth. The cutting teeth 315 may extend approximately one quarter inch to approximately two inches from the conical surface 310. The cutting teeth 315 may include a diameter or exterior dimension of approximately one quarter inch to approximately two inches.

The conical portion 300 extends around an inside or an interior of the gauge portion 100. The conical portion 300 is integral or connects with the gauge inner edge 120. With reference to FIG. 3, the conical portion 300 forms or partially defines a conical opening 350 around the interior of the gauge portion 100, i.e., along the gauge inner edge 120. The conical portion 300 also forms or partially defines a concave or recessed region that forms a core during a drilling operation of the hammer bit 10. The flat surfaces 310 and 320 are recessed from the gauge portion 100. The conical portion 300 may have a depth D of approximately ½ inch to approximately 6 inches from the innermost flat surface 320 to the gauge inner edge 120 or the conical opening 350.

The gauge portion 100, the angled portion 200, and the conical portion 300 form the face side 105 that provides the improved directional control and penetration efficiency for the hammer bit 10. The face section 105 is generally non-planar, i.e., the face side 105 does not have a single broad and flat face section or surface that is generally parallel or square to the bore hole. The face side 105 includes the conical opening 350 leading into the conical portion 300. The face side 105 includes the gauge portion 100 and its gauge cutting surface 110, which is angled or curved. The face section 105 includes the angled portion 200 and its tapered surface 210, which is angled with respect to the longitudinal axis of the hammer bit 10. The face side 105 further has the reduced surface area size. These features reduce the surface area of the hammer bit 10 striking into the earth and into the bore hole and results in deeper penetration rates when the hammer bit 10 strikes the earth and the bore hole.

The hammer bit 10 further includes a flushing system 400 to vent the bore hole and the hammer bit 10 and to provide drilling fluids to the bore hole and boring surfaces. The flushing system 400 includes on or more side openings 410 positioned in tapered sides 510 of the hammer bit 10. As such, the side openings 410 are positioned in the outer diameter of the hammer bit 10. The side openings 410 may have an elliptical or ovular shape. The side openings 410 may angle or direct fluids and flow toward the face side 105 or in the direction of the bore hole. The side openings 410 are behind the gauge portion 100. By positioning the side openings 410 in the tapered sides 510 of the hammer bit 10 behind the gauge portion 100, the side openings 410 are less likely to plug-up in soft materials. The location and orientation of the side openings 410 still provides jetting action of the drilling fluids to wash away materials, which allows the hammer bit 10 to turn and steer faster.

With reference to FIGS. 7-11, the flushing system 400 is shown in detail. The flushing system 400 may further include a conical portion opening 420 that is generally parallel to a longitudinal axis of rotation of the hammer bit 10. The conical portion opening 420 may intersect with the side openings 410 in the interior of the hammer bit 10. The conical portion opening 420 assists in drilling in hard rock formation since its provides some flush of drilling fluids to the face of the hammer bit 10, however, the conical portion opening 420 will not stop the flushing action of the outer side openings 410 should the conical portion opening 420 become plugged in soft formations. In FIG. 6, the conical portion opening 420 is shown in the first flat surface 310. Additional openings may be placed in the conical portion 300.

The hammer bit 10 further includes a plurality of vent holes 440 that exhaust gas or provide a fluid into the bore hole. The vent holes 440 may further communicate with the flushing system 400. The vent holes 440 may be positioned in a back body portion 540 of the hammer bit 10. The vent holes 440 are generally of a smaller diameter than the side openings 410 and the conical portion opening 420. The vent holes 440 are recommended for use when boring into soft formations.

With reference to FIGS. 8-11, sectional views of the hammer bit 10 and the flushing system 400 are shown. The side openings 410, the conical portion opening 420, and the vent holes 440 are all in open communication with a main flushing chamber 550 through the hammer bit 10. A side opening channel 415 connects the side opening 410 to the main flushing chamber 550. A vent hole channel 445 joins the vent hole 440 with the main flushing chamber 550. The conical portion opening 420 connects to the main flushing chamber 550 by a conical portion opening channel 425. The flushing system 400 vents the hammer bit 10 and the bore hole. The flushing system 400 also provides drilling fluid to the bore hole.

In operation, the face side 105 is directed to the bottom of the bore hole by the drill string 600. The conical portion opening 420 is positioned in the conical portion 300. The conical portion opening 420 generally opens in a direction that is perpendicular to the opening provided by the side openings 410. The conical portion opening 420 is positioned in the conical portion 300 at the face side 105, while the side openings 410 are positioned behind the gauge portion 100 in the tapered sides 510 of the outer body 500. Said another way, the face side 105 is fluidly connected to the tapered sides 510 by the side openings 410 and the conical portion opening 420. The hammer bit 10 includes two side openings 410 behind the gauge portion 100. In other aspects, the hammer bit 10 may include three, four, five or more additional side openings 410 behind the gauge portion 100.

The vent holes 440 may be located in the back body portion 540 of the hammer bit 10. The vent holes 440 assist in keeping air and drilling fluid moving through the hammer bit 10 if the side openings 410 or the conical portion opening 420 become restricted or occluded in soft earthen formations. The vent holes 440 also help with the exhaust of the hammer bit 10. Although one vent hole 440 is shown in the hammer bit 10, additional vent holes 440 may be employed.

The intersecting configuration of the side opening 410 and the conical portion opening 420 also keeps flushing flow going through the hammer bit 10 until an occlusion dries and/or clears itself. If drilling material or soft formation is pushed into the conical portion opening 420, it will be blown away very easily by fluids or gas from the intersecting side opening 410. Also, if the conical portion opening 420 becomes occluded or blocked with material, such will not stop the side openings 410 from venting or flowing.

The main body 500 of the hammer bit 10 includes the tapered sides 510 joining the gauge portion 100 and the back body portion 540. The tapered sides 510 form the lateral sides or side portions of the hammer bit 10. The tapered sides 510 of the hammer bit 10 are generally steeper than the sides of existing bits. The tapered sides 510 improve the rate of penetration of the hammer bit 10.

The tapered sides 510 join the gauge portion 100 with the back body 540. The tapered sides 510 taper inward in the direction away from the gauge portion 100 or the face side 105, i.e., the tapered sides 510 taper inward toward the back body 540. This allows the hammer bit 10 to deflect much fastener when turning and/or steering the hammer bit 10. With reference to FIG. 2, the tapered sides 510 are shown. The tapered side 510 forms an angle of approximately 10° to approximately 45° relative to the longitudinal axis of the hammer bit 10. In other aspects, tapered sides 510 forms an angle of approximately 20° to approximately 35° relative to the longitudinal axis of the hammer bit 10. The particular degree of the tapered sides 510 will depend on the size and diameter of the hammer bit 10. The gauge outer edge 130 joins the tapered sides 510. A transition between the gauge outer edge 130 and the tapered sides 510 may by a straight, rounded of concave edge. The tapered sides 510 may cover approximately ⅔ or more of the distance between the shaft 600 and the face side 105. As the tapered sides 510 taper inward, the tapered sides 510 eventually join the back body 540, which may have an outer surface generally parallel to the drill string 600.

The angled portion 200 includes a long, gradual taper forming approximately one-half or more of the diameter of the hammer bit 10. This provides a hammer bit 10 with a larger area to deflect with soft formations and to assist in navigating a hammer bit and any drilling conditions including hard rock, dirt and sand, etc.

The conical portion 300 increases the rate of penetration of the hammer bit 10 into hard formations. Once the outer diameter of the bore hole is cut by the gauge portion 100, the center cone-shaped earthen formation fractures very easily in hard drilling conditions.

The hammer bit 10 is designed to cut the outside diameter of the bore hole first using the gauge portion 100, which is approximately one-half of the circumference of the hammer bit 10. The gauge side cutters 515 on the outer body 500 maintain the bore hole at a slightly larger diameter than the body of the hammer bit 10.

The hammer bit 10 may be formed from conventional metal and alloys typically used in the mining industry. The gauge portion 100, the angled portion 200, and the conical portion 300 may form an integral unit. The hammer bit 10 includes a shaft 600 to connect to a drill string.

Any of the cutting teeth herein described may be formed from a carbide material of multiple different grades and in multiple different formations. The cutting teeth may be pressed, braised, welded or glued to the receivers 209 of the hammer bit 10. The cutting teeth may be made from any material that is harder and more wear resistant than the body 500 of the hammer bit 10. The hammer bit 10 requires approximately one-half the cutting teeth that are normally needed for conventional hammer bits. This reduces the cost of manufacturing and maintenance. The hammer bit 10 is further easily navigated due to the gauge coring ability.

The back body portion 540 also includes a plurality of back body cutters 552. The back body cutters 552 may be ¾ inch carbide cutters. The back body cutters 552 extend from the back body portion 552. The back body cutters 552 help reduce the wearing or rubbing on the body 500 of the hammer bit 10 during the drilling process. The back body cutters 552 are generally of a harder material than the body 500, and the back body cutters 552 reduce contact between the earth and rock with the body 500 of the hammer bit 10. The back body cutters 552 increase the length of service time for the hammer bit 10. In the aspect shown in the FIGS., five back body cutters 552 are spaced around the back body portion 540 on the side of the hammer bit 10 opposite the angled portion 200, i.e., the back body cutters 552 are positioned on the side of the hammer bit 10 with the gauge portion 100.

Figure 12:
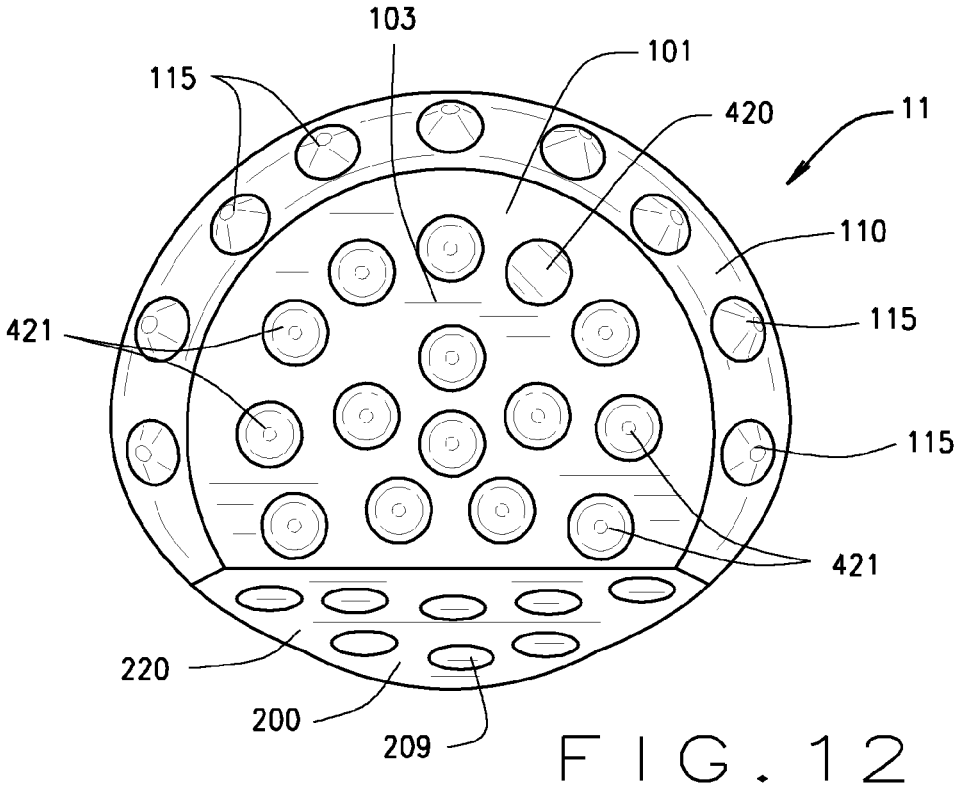
FIG. 12 shows a view of the face side of the second hammer bit.
Figure 13:
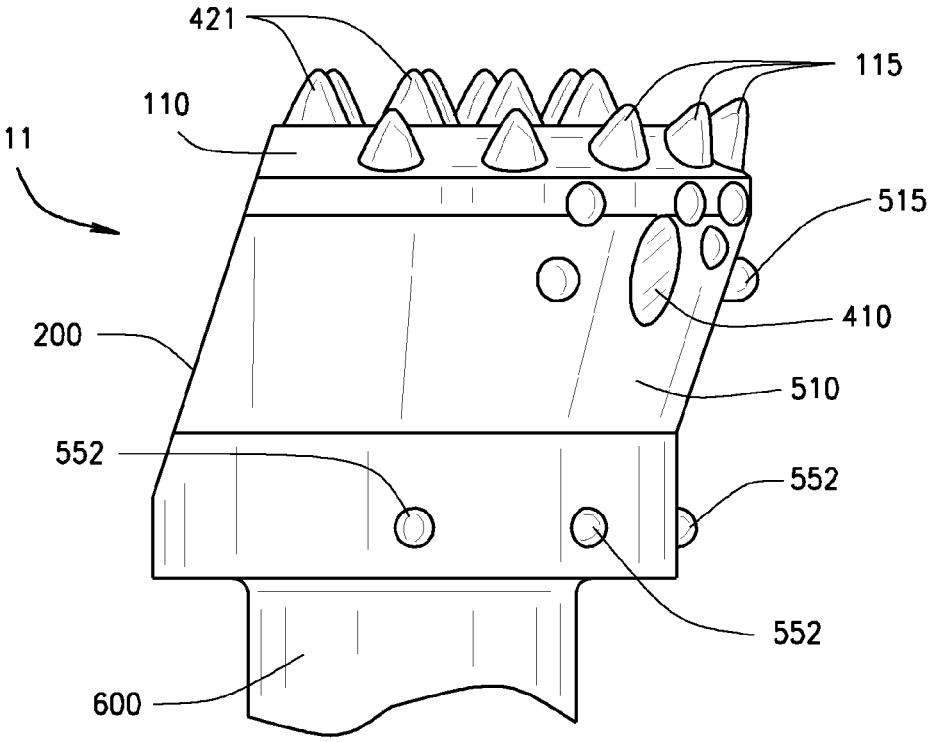
FIG. 13 shows side a view of the second hammer bit.

A second hammer bit 11 is shown in FIGS. 12 and 13. The second hammer bit 11 includes a generally flat gauge portion 101. Otherwise, the second hammer bit 11 is generally similar to the hammer bit 10, and like features of the second hammer bit 11 are numbered accordingly. The hammer bit 11 includes the tapered sides 510 forming the side or lateral portions of the hammer bit 11. The tapered sides 510 provide the second hammer bit 11 with the improved penetration and directional control as described above with respect to the hammer bit 10.

The generally flat gauge portion 101 includes a generally flat gauge surface 103. A plurality of cutters 421 extend from the generally flat gauge surface 103. The generally flat gauge portion 101 is in a plane generally perpendicular to a longitudinal axis of the hammer bit 11. The generally flat gauge portion 101 transitions into the angled portion 200.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed is:

1. A hammer bit, comprising:

a face side at a lower end of a longitudinal axis of the hammer bit, wherein the face side includes a gauge portion forming a leading cutting surface at the lower end, and wherein the face side includes an angled portion, the angled portion positioned upward along the longitudinal axis from the gauge portion, a conical portion between the gauge portion and the angled portion along the longitudinal axis, the conical portion joins the angled portion, wherein the conical portion includes stepped cutting surfaces recessed from the gauge portion, and the cutting surfaces include cutting teeth;

a back body portion at an upper end of the longitudinal axis of the hammer bit, the back body portion integral with a shaft; and, tapered sides joining the face side with the back body portion, wherein the tapered sides taper inward toward the back body portion.

2. The hammer bit according to claim 1, wherein the tapered sides form lateral sides or side portions of the hammer bit.

3. The hammer bit according to claim 1, wherein the gauge portion is defined by a gauge outer edge, and the gauge outer edge joins or transitions to the tapered sides.

4. The hammer bit according to claim 1, wherein the tapered sides form an angle of approximately 10° to approximately 45° relative to the longitudinal axis of the hammer bit.

5. The hammer bit according to claim 1, wherein the tapered sides join the gauge portion and taper inward in a direction away from the gauge portion.

6. The hammer bit according to claim 1, wherein the tapered sides comprise a plurality of side openings, wherein the side openings are behind the gauge portion, and the side openings are in fluidic communication with a main flushing chamber of the hammer bit.

7. The hammer bit according to claim 1, wherein the tapered sides comprise a plurality of side openings, wherein the face side includes an opening, and wherein the opening intersects with the side openings.

8. The hammer bit according to claim 1, wherein the conical portion includes a concave or recessed region that forms a core during operation of the hammer bit.

9. The hammer bit according to claim 8, wherein the cutting teeth of the conical portion extend into the concave or recessed region.

10. The hammer bit according to claim 1, wherein the tapered sides comprise a plurality of side openings leading to side opening channels, the side opening channels leading to a main flushing chamber, the conical portion includes a conical portion opening leading to a conical portion opening channel, and the conical portion opening channel intersects with one of the side opening channels.

11. The hammer bit according to claim 1, wherein the one or more stepped cutting surfaces include one or more generally flat surfaces, and wherein the one or more generally flat surfaces are recessed from a gauge cutting surface of the gauge portion.

12. The hammer bit according to claim 11, wherein a conically shaped transition surface joins the gauge portion and one of the generally flat surfaces.

13. The hammer bit according to claim 1, wherein the conical portion extends around an inside or an interior of the gauge portion.

14. The hammer bit according to claim 1, wherein the conical portion includes an opening to vent or flush.

15. The hammer bit according to claim 1, wherein the gauge portion covers approximately one-half or less of an outer circumference of the hammer bit.

16. The hammer bit according to claim 1, further comprising a vent hole in the back body portion of the hammer bit.

17. The hammer bit according to claim 1, further comprising a vent hole in a back body portion of the hammer bit leading to a vent hole channel, the vent hole channel leading to a main flushing chamber.

18. The hammer bit according to claim 17, wherein the flushing system fluidly connects a face side of the hammer bit with a lateral side of the hammer bit.

19. The hammer bit according to claim 1, wherein the tapered sides comprise a plurality of side openings, the face side includes a face side opening, and the face side opening and the side openings fluidly connect the face side of the hammer bit with the tapered sides of the hammer bit.

20. The hammer bit according to claim 1, further comprising a flushing system comprising an opening in the face side leading to a main flushing chamber and side openings in the tapered sides leading to a main flushing chamber.

21. The hammer bit according to claim 1, wherein the angled portion includes a gradual taper that forms approximately one-half or more of a diameter of the hammer bit.

22. The hammer bit according to claim 1, wherein the angled portion includes a first lateral side and a second lateral side, wherein the first lateral side of the angled portion joins with a gauge first lateral edge, and the second lateral side of the angled portion joins with a gauge second lateral edge.

23. The hammer bit according to claim 1, wherein the gauge portion is generally flat, and the gauge portion transitions into the angled portion.

24. A hammer bit, comprising:

a face side, wherein the face side includes a gauge portion forming a leading cutting surface, and wherein the face side includes an angled portion;

a back body portion, the back body portion integral with a shaft;

tapered sides joining the face side with the back body portion, wherein the tapered sides taper inward toward the back body portion; and, a conical portion between the gauge portion and the angled portion, wherein the conical portion includes one or more cutting surfaces recessed from the gauge portion, wherein the one or more cutting surfaces include one or more generally flat surfaces, wherein the one or more generally flat surfaces are generally perpendicular to a longitudinal axis of the hammer bit.

25. A hammer bit, comprising:

a face side, wherein the face side includes a gauge portion forming a leading cutting surface, and wherein the face side includes an angled portion;

a back body portion, the back body portion integral with a shaft;

tapered sides joining the face side with the back body portion, wherein the tapered sides taper inward toward the back body portion; and, a conical portion between the gauge portion and the angled portion, wherein the conical portion includes one or more cutting surfaces recessed from the gauge portion, wherein the one or more cutting surfaces include one or more generally flat surfaces, wherein the conical portion includes an opening in one of the flat surfaces to vent or flush.

26. A hammer bit, comprising:

a main body forming a longitudinal axis, the main body having a face side at a lower end of the longitudinal axis, tapered lateral sides, and a back body portion at an upper end of the longitudinal axis;

the face side comprising a gauge portion and an angled portion;

the gauge portion is curved or rounded and forms a leading cutting surface of the hammer bit;

the angled portion includes a generally flat surface with a gradual taper that forms approximately one-half or more of a diameter of the face side of the hammer bit with cutters extending from the generally flat surface;

the tapered lateral sides join the gauge portion and the back body portion, and the tapered lateral sides taper inward in a direction away from the gauge portion; and, wherein the tapered lateral sides comprise a side opening, the face side comprises a face side opening to vent or flush, and the face side opening and the side opening fluidly connect the face side of the hammer bit with the tapered lateral sides of the hammer bit.

27. A hammer bit, comprising:

a main body forming a longitudinal axis, the main body having a face side at a lower end of the longitudinal axis, tapered lateral sides, and a drill string side portion at an upper end of the longitudinal axis;

the face side comprising a gauge portion and an angled portion, and the gauge portion transitions into the angled portion;

the gauge portion is generally flat and forms a leading cutting surface of the hammer bit, and the angled portion is generally flat;

the gauge portion is defined by a gauge outer edge, and the gauge outer edge joins or transitions to the tapered lateral sides;

the tapered lateral sides taper inward toward the drill string side; and, wherein the tapered lateral sides comprise a side opening, the face side comprises a face side opening to vent or flush, and the face side opening and the side opening fluidly connect the face side of the hammer bit with the tapered lateral sides of the hammer bit.

28. A hammer bit, comprising:

a main body having a face side, lateral sides, and a drill string side;

the face side comprising a gauge portion, a conical portion, and an angled portion;

the gauge portion is curved or rounded and forms a leading cutting surface of the hammer bit;

the conical portion is concaved or recessed relative to the gauge portion, the conical portion including an opening;

the angled portion is adjacent the gauge portion and the conical portion; and, the lateral sides include holes to vent or flush the hammer bit or bore hole, the holes are in fluidic communication with the opening of the conical portion, wherein the holes are behind the gauge portion.

29. A method of drilling into the earth, comprising:

providing a hammer bit, the hammer bit comprising: a face side at a lower end of a longitudinal axis of the hammer bit, a drill string side at an upper end of the longitudinal axis of the hammer bit, and tapered lateral sides joining the face side and the drill string side, wherein the face side has a gauge cutting surface at the lower end and an angled portion, the angled portion positioned upward along the longitudinal axis from the gauge portion, wherein the gauge cutting surface provides a leading cutting surface, a conical portion between the gauge portion and the angled portion along the longitudinal axis, wherein the conical portion includes stepped cutting surfaces recessed from the gauge portion, the cutting surfaces include cutting teeth, the conical portion joins the angled portion;

connecting the hammer bit to drill string; and, rotating the hammer bit and urging the hammer bit into the earth.

30. The method according to claim 29, further comprising venting or flushing the hammer bit or a bole hole through openings in the tapered lateral sides of the hammer bit.

* * * * *